US005727655A

United States Patent [19]

Pitman

[11] Patent Number: 5,727,655

[45] Date of Patent: Mar. 17, 1998

[54] PLATFORM LIFTER

[75] Inventor: Frank Mark Pitman, Duncan, S.C.

[73] Assignee: Milliken Research Corporation, Spartanburg, S.C.

[21] Appl. No.: 695,699

[22] Filed: Jul. 12, 1996

[51] Int. Cl.[6] ..... B66F 7/06

[52] U.S. Cl. ..... 187/211; 182/141; 108/145

[58] Field of Search ..... 187/211; 182/141; 108/145, 144, 147; 312/131

[56] References Cited

U.S. PATENT DOCUMENTS

| | | | |
|---|---|---|---|
| 451,006 | 4/1891 | Singer . | |
| 2,370,887 | 3/1945 | Soskin | 182/141 |
| 2,874,805 | 2/1959 | Jahnel | 187/211 |
| 3,805,712 | 4/1974 | Taylor et al. | 108/136 |
| 4,073,240 | 2/1978 | Fly | 108/20 |
| 4,405,116 | 9/1983 | Eisenberg | 254/122 |
| 4,534,544 | 8/1985 | Heide | 182/141 |
| 4,718,355 | 1/1988 | Houghton | 108/147 |
| 4,848,732 | 7/1989 | Rossato | 187/211 |
| 4,926,760 | 5/1990 | Sack | 108/145 |
| 5,111,912 | 5/1992 | Kempf | 187/211 |
| 5,347,773 | 9/1994 | Thil | 52/126.5 |

FOREIGN PATENT DOCUMENTS

| | | | |
|---|---|---|---|
| 197805 | 5/1978 | Canada | 5/14 |
| 21386 | 1/1981 | European Pat. Off. | 312/131 |
| 345-421-A | 12/1989 | European Pat. Off. . | |
| 1195028A | 6/1965 | Germany | 187/211 |

*Primary Examiner*—William E. Terrell
*Assistant Examiner*—Khoi H. Tran
*Attorney, Agent, or Firm*—Terry T. Moyer; Earle R. Marden

[57] ABSTRACT

A platform which is raised and lowered evenly in a vertical direction only by a pair of piston activated four-bar linkages which are linked together through an endless cable or belt which will not allow one four-bar linkage to act independently of the other.

1 Claim, 4 Drawing Sheets

*FIG. –5–*

PLATFORM LIFTER

This invention relates generally to lifters to raise and lower personnel and material relative to a fixed commodity or surface and specifically to a lifter which moves in a vertical plane without sliding or canting in a horizontal direction.

Prior to this invention many lifting systems consisted of a hydraulically actuated scissors mechanism and a platform. If the platform is relatively long in one direction two scissors mechanisms are required (one on each end). This type of system generally requires a hydraulic flow divider to ensure that the platform remains parallel to the ground (i.e., to ensure each scissors mechanism moves the same amount) if the weight is not distributed equally between the scissors.

Other lifting systems used a four-bar (parallelogram) mechanism where the platform acts as one of the links. While this type of system ensures that the platform remains parallel to the ground there is one drawback. The platform moves horizontally as it is raised.

Therefore, it is an object of this invention to provide a lifting system using a two four-bar mechanism that raises a platform and ensures that the platform remains level to the ground while maintaining a fixed horizontal position.

Other objects and advantages of the invention will become readily apparent as the specification proceeds to describe the invention with reference to the accompanying drawings in which.

Figure 1:
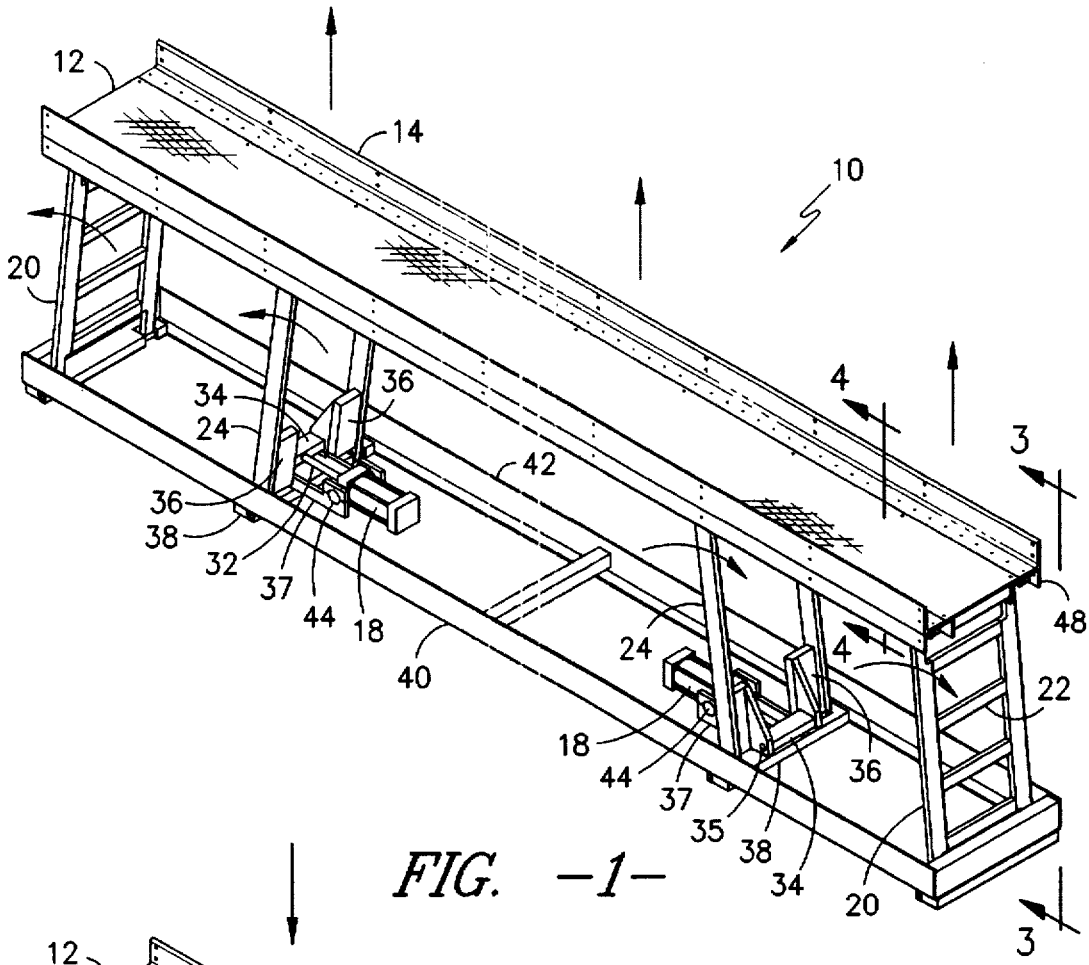
FIG. 1 is a perspective view of the platform lifter in the raised position.
Figure 2:
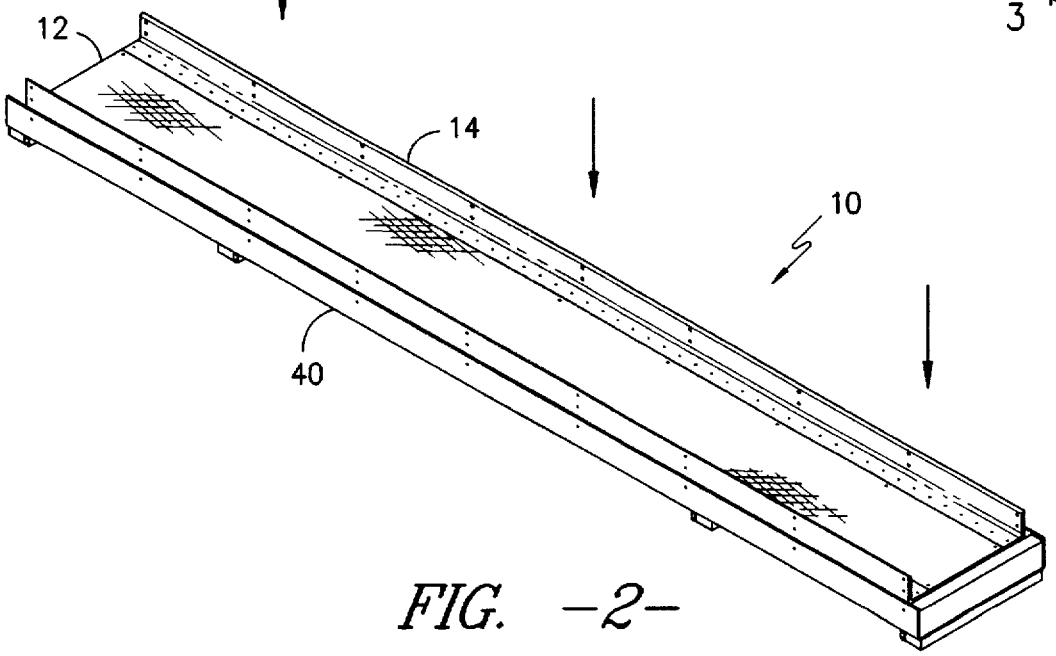
FIG. 2 is a perspective view of the platform lifter in its lowered or rested position.

Looking now to FIGS. 1 and 2 the lifter 10 is shown in its up position in FIG. 1 and in its lower rested position in FIG. 2. The lifter 10 basically consists of a platform 12 with upstanding sides 14 and a bottom, two pivotally mounted four-bar mechanisms and hydraulic pistons 18 to raise and lower the four-bar mechanisms which are activated by a hydraulic pump (not shown)

Figure 5:
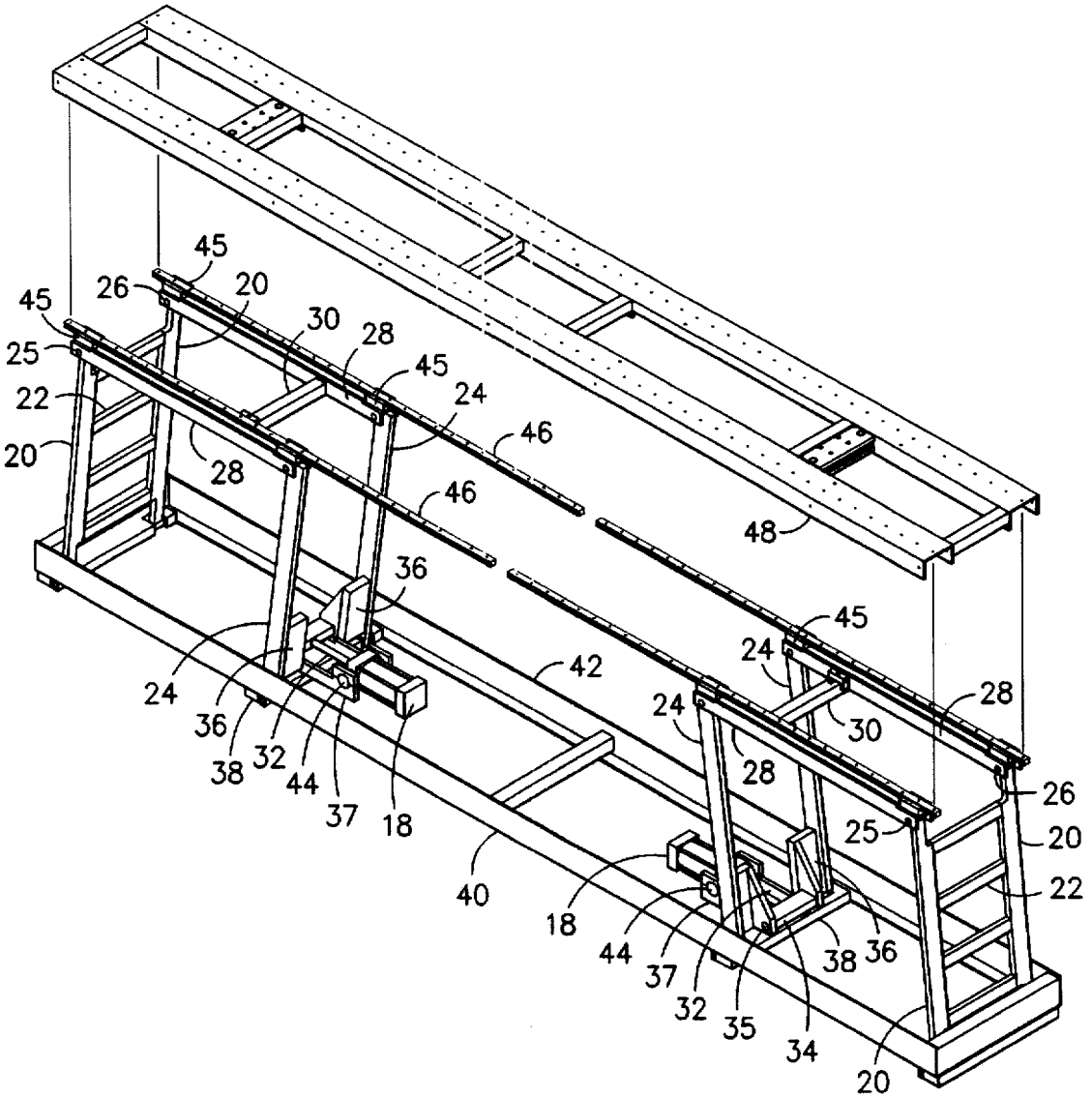
FIG. 5 is a perspective, partially exploded view of the lifter as shown in FIG. 1

Looking at FIG. 5, each four-bar mechanism consists of two end bars 20 interconnected by rigid cross members 22 and two independent bars 24 with the end bars 20 being pivotally connected at 25 and 26 to the members 24 by a bar member 28. The bar members 28 are rigidly connected to one another by the bridging bar member 30. The four-bar mechanisms are pivoted towards one another to lower the platform 12 and away from one another to raise the platform 12.

Looking at FIGS. 1 and 5, it can be seen that the hydraulic pistons 18 through the piston rods 32 move in and out to move the plates 34 pivotally mounted at 35 to rotate the plates 36 welded or otherwise secured to the bar members 24 and thereby rotate them in the desired direction. The pistons 18 are pivotally secured in position by the L-shaped arms 37 which are connected to the cross-bar 38 extending between the sides 40 & 42 of the stationary frame 40. The pistons pivotally mounted at 44 to the arms 37 allow the piston to rock as the platform is raised or lowered.

Figure 3:
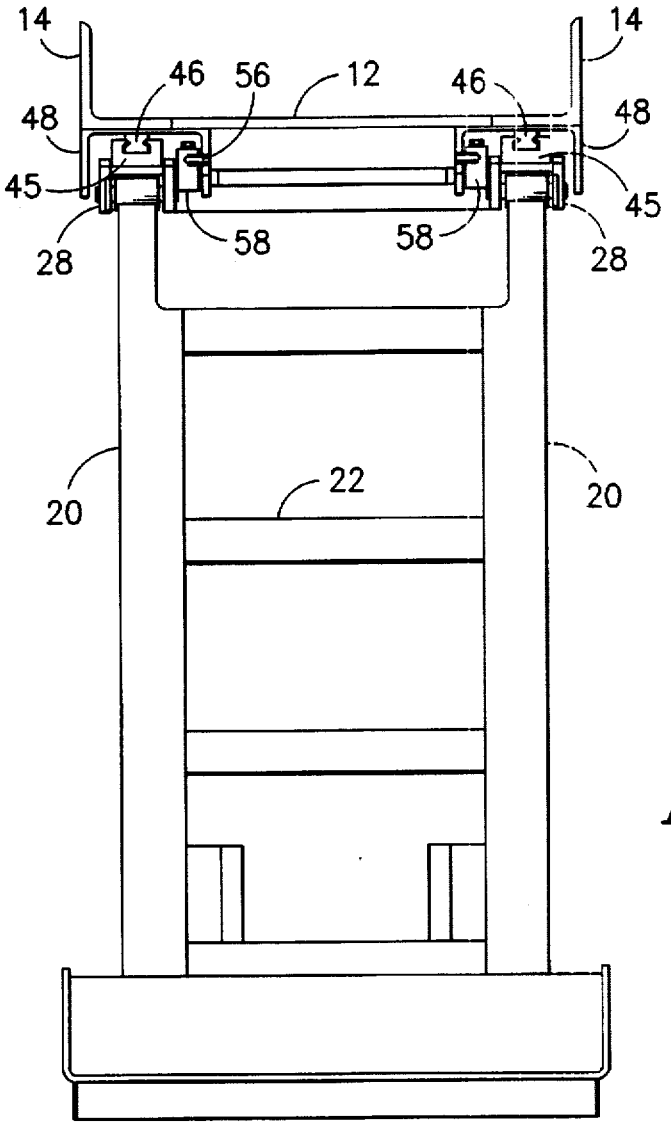
FIG. 3 is an end view taken on line 3—3 of FIG. 1.
Figure 4:
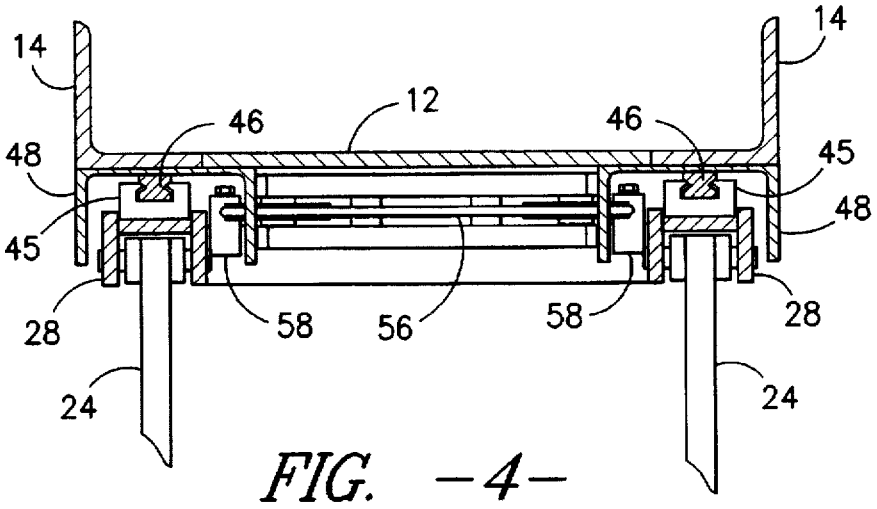
FIG. 4 is a section view taken on level 4—4 of FIG. 1.

Looking now to FIG. 3–5 there is shown a plurality of linear bearings 45 mounted on the top of the bar member 28 to accommodate the elongated slide bar member 46 riveted or otherwise secured to the bottom of the channel sections 48 on which the platform 12 is secured to allow the bar member 28 to slide with the bearings thereon upon pivotal movement of the bars 20 and 24 without horizontal movement of the platform 12 as it is raised or lowered.

Figure 6:
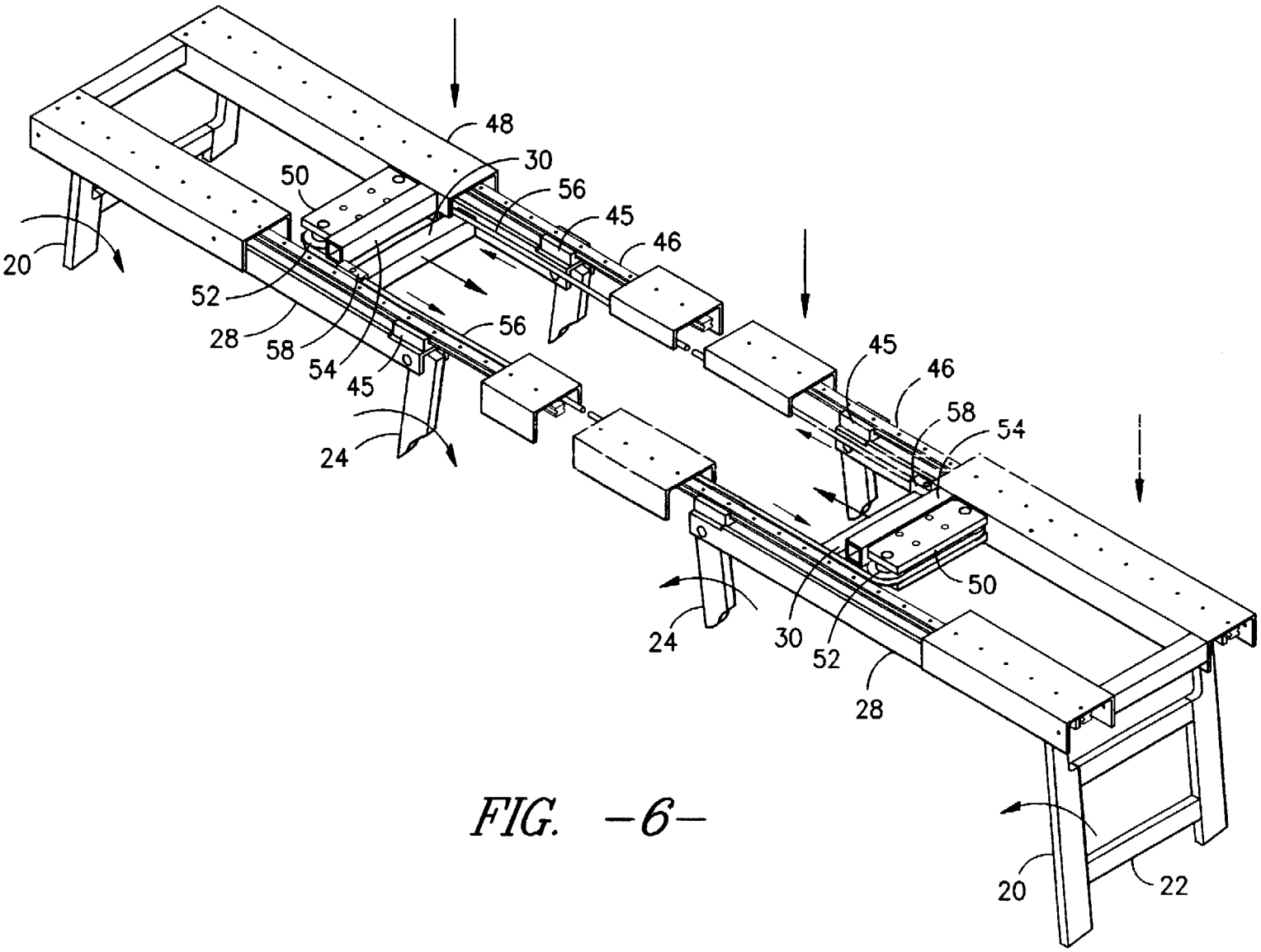
FIG. 6 is a perspective view of top portion of the lifter mechanism with the platform and portions removed to show parts thereof.

Looking now to FIG. 3, 4, and 6 there is shown a pair of pulley blocks 50, with pulleys 52 rotatably mounted therein, mounted to a rectangular support member 54 welded or otherwise secured to the outside of the channel member 48. As shown in FIG. 6 an endless cable member 56 is guided by the pulleys 52 and passes through an opening, not shown, in the wall of the channel member 48 to cause the two sets of four-bar linkage mechanisms to move together to provide uniform up and down motion of the platform 12. This is accomplished by securing the cable connectors 58 to the briding bar member 30 at both ends of the lifter to cause both sets of four-bar linkages to move in unison as the cable member 56 is rotated by movement of the bar member 28.

As discussed briefly above, the four-bar linkages are pivoted inward to lower the platform 12 and outward to raise the platform by the pistons 18 supplied hydraulic fluid by a pump (not shown). The cable 56 attached to the bar members 28 through the cable connectors 58 causes both of the four-bar mechanisms to move in unison to prevent jerky or uneven lowering of the platform as the bar members 28 slide relative to the slide bar member 46 connected to the bottom of the platform to allow vertical movement of the platform without horizontal movement.

It is obvious the combination of the cable location to the four-bar linkages provides that even and smooth lowering of the platform is accomplished without a jerky or sliding movement of same.

Although I have discussed the preferred embodiment of the invention, I contemplate that changes may be made without departing from the scope or spirit of the invention and I desire to be limited only by the scope of the claims.

I claim:

1. An automatic raisable and lowerable platform comprising: a platform, a track mechanism mounted on the bottom of said platform, two pairs of four-bar linkages operably associated with said track mechanisms to raise and lower said platform when pivoted upwardly or downwardly, respectively, and means to pivot said linkage periodically when it is desired to raise and lower said platform, said pairs of four-bar linkages being interconnected by an endless cable so that said four-bar linkages are pivoted in unison, each of said four-bar linkages having an upper bar substantially parallel to said track mechanism, said upper bars having a plurality of bearings thereon into which said track mechanism rests so that said upper bars will slide relative to said platform when said four-bar linkages are pivoted.

* * * * *